United States Patent [19]

Seitz et al.

[11] Patent Number: 4,520,949

[45] Date of Patent: Jun. 4, 1985

[54] PROTECTIVE HOUSING FOR COATING APPLICATOR

[75] Inventors: David M. Seitz, Blissfield, Mich.; Richard Weinstein, Toledo, Ohio

[73] Assignee: Champion Spark Plug Company, Toledo, Ohio

[21] Appl. No.: 483,865

[22] Filed: Apr. 11, 1983

[51] Int. Cl.[3] ..... B67D 1/16

[52] U.S. Cl. ..... 222/108; 222/183; 220/4 B

[58] Field of Search ..... 239/700, 701, 702, 703, 239/223, 224, 288, 288.5; 222/183, 108, 130, 131, 173; 220/4 B, 446, 447, 448, 319, 5 A; 206/45.14

[56] References Cited

U.S. PATENT DOCUMENTS

| | | | |
|---|---|---|---|
| 1,802,078 | 4/1931 | Exley | 15/198 |
| 2,597,573 | 5/1952 | De Groff | 299/140 |
| 2,714,527 | 8/1955 | Thompson | 299/29 |
| 2,747,931 | 5/1956 | Wilson | 299/28.5 |
| 2,815,983 | 12/1957 | Hunter | 299/28.5 |
| 2,966,283 | 8/1984 | Darvie | 222/183 |
| 3,551,013 | 12/1970 | Trojanowski et al. | 287/119 |
| 3,868,040 | 2/1975 | Langmack et al. | 220/18 |
| 3,935,999 | 2/1976 | Weyn | 239/288.5 |
| 3,940,061 | 2/1976 | Gimple et al. | 239/15 |
| 4,225,201 | 9/1980 | Davis | 312/125 |

*Primary Examiner*—Joseph J. Rolla
*Assistant Examiner*—Louise S. Heim
*Attorney, Agent, or Firm*—Emch, Schaffer & Schaub

[57] ABSTRACT

A housing for a coating applicator having a pair of mating housing members which define a chamber for a portion of a coating applicator and which are supported and retained by a front and rear bulkhead, the rear bulkhead having a spring means urging at least one of the housing members against the front bulkhead.

12 Claims, 10 Drawing Figures

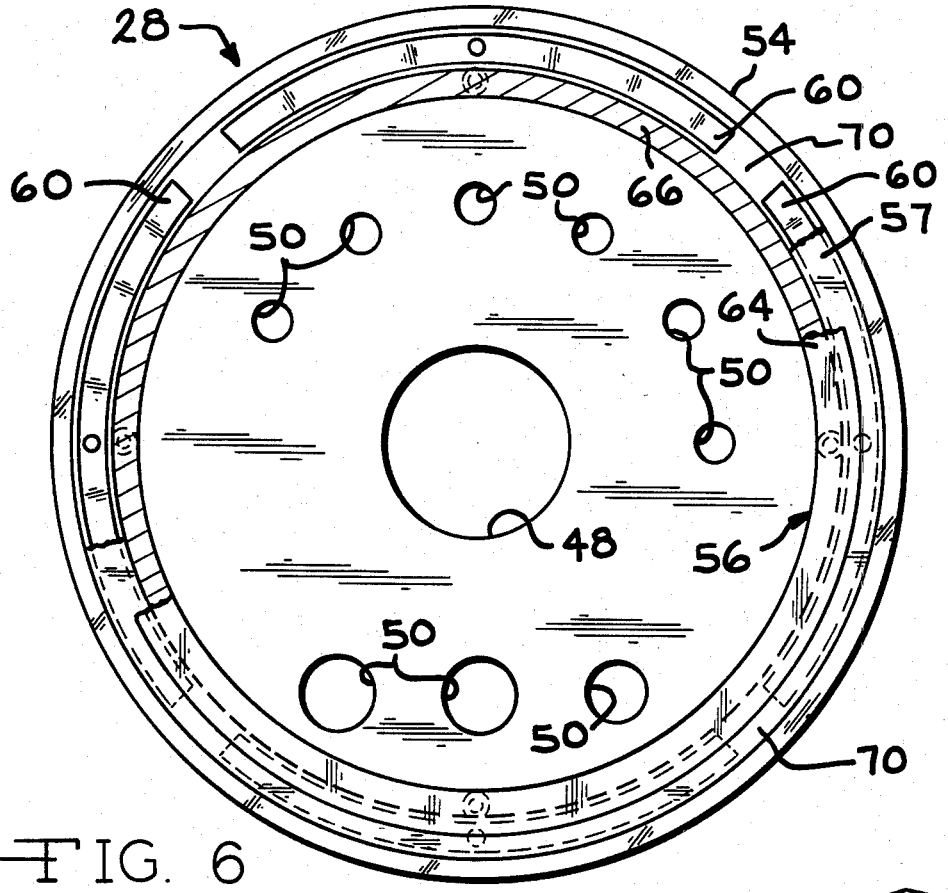
FIG. 6
FIG. 7
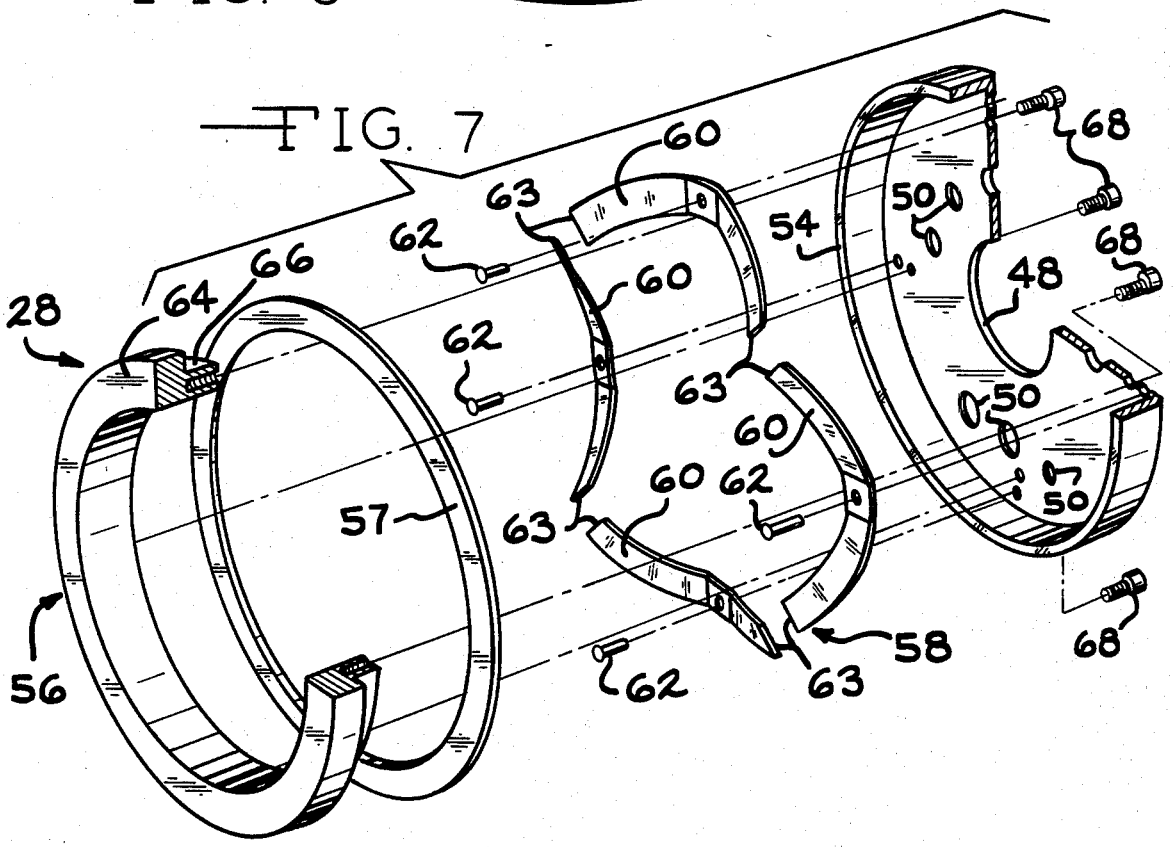

FIG. 8
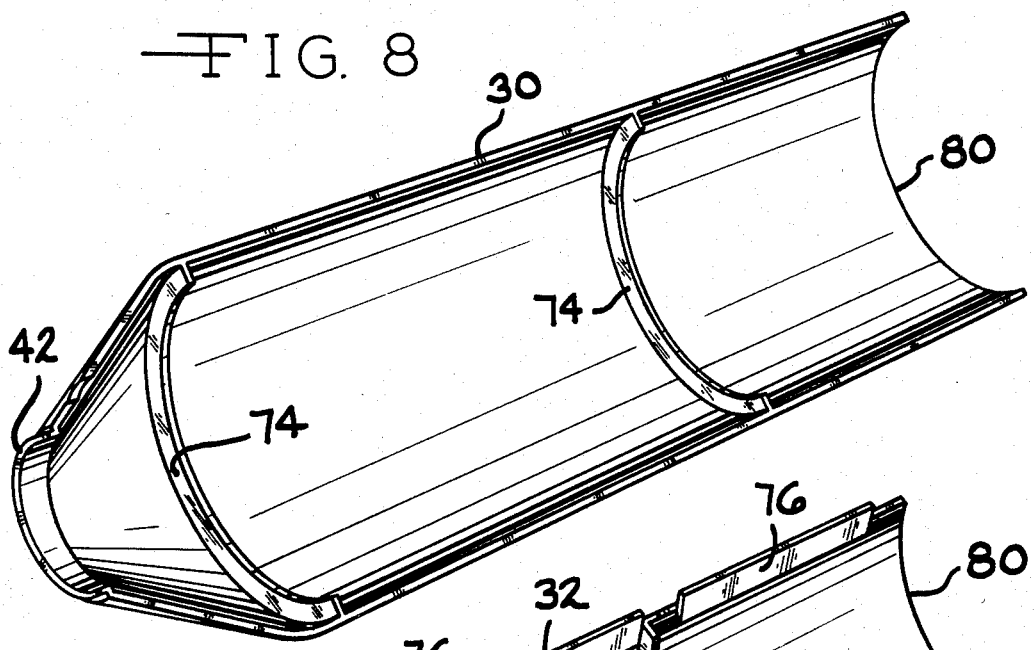
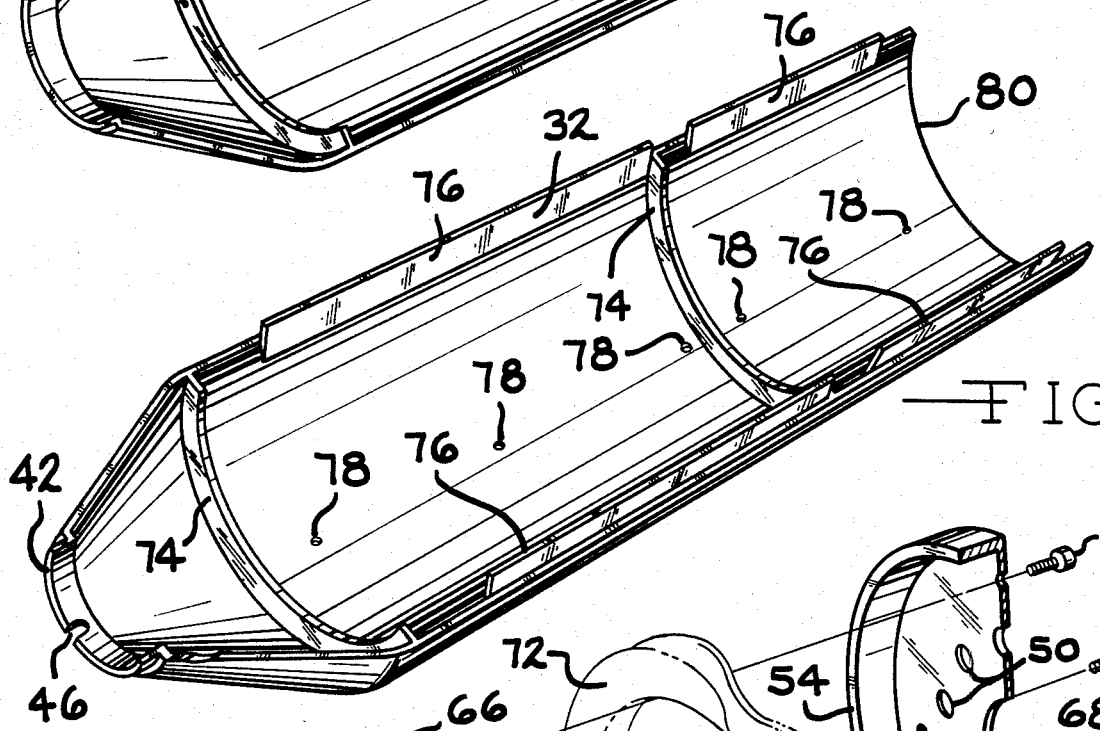
FIG. 9
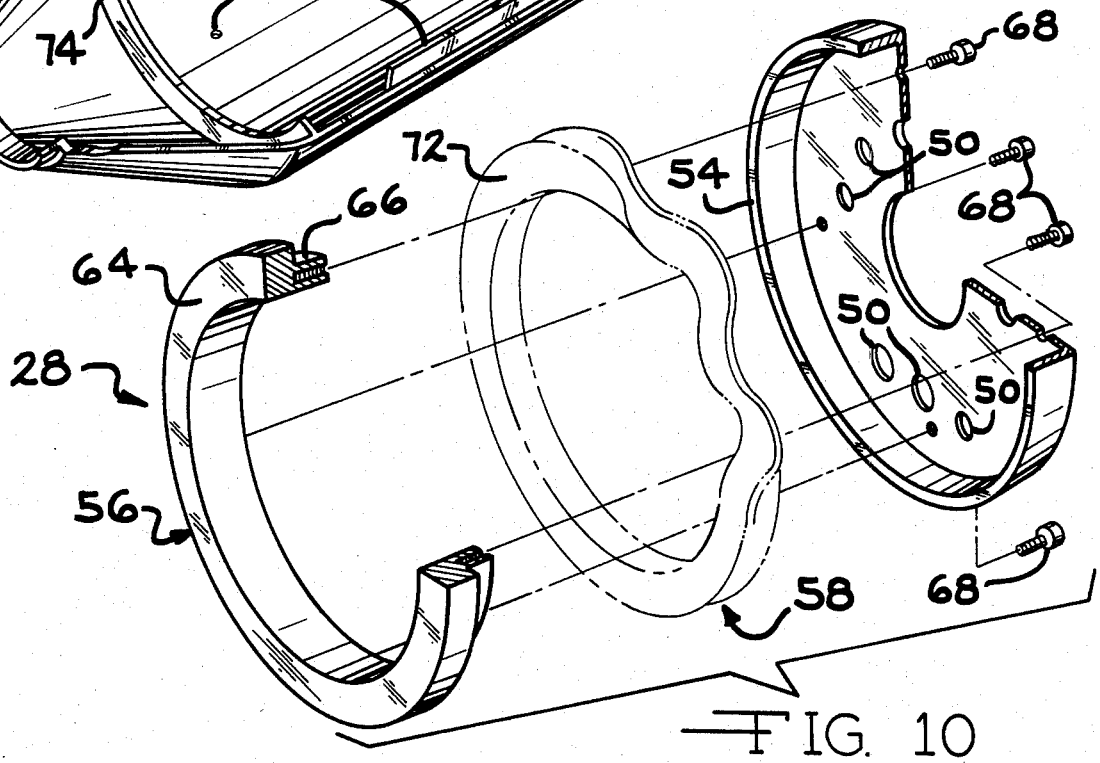
FIG. 10

PROTECTIVE HOUSING FOR COATING APPLICATOR

BACKGROUND OF THE INVENTION

Coating applicators, including automatic spray painting equipment, are being used in an ever increasing variety of work places. Typical electrostatic equipment often involves the use of high voltages, electric motors, turbines and numerous air, paint and solvent lines. Often times, this spray painting equipment is exposed to work conditions that are harmful to safe and effective operation of the equipment. These hazards include the possibilities of the supply lines being severed and equipment malfunction due to, for example, the turbine becoming fouled by airborne contaminants.

It is therefore an object of this invention to provide a coating applicator with a housing to protect the components of the applicator while in use.

It is a further object of this invention to provide a housing for a coating applicator that can be quickly and easily installed and removed without the use of any tools and without having to stand in front of the applicator.

These and other objects and advantages of the present invention will become more apparent from a review of the following specification and drawings.

SUMMARY OF THE INVENTION

The present invention relates to the development of a protective housing for material coating applicators. The protective housing consists of a front and rear bulkhead and a pair of mating housing members. The front and rear bulkheads serve to retain the mating housing members which protect the components of the material coating applicator.

No tools are required for removal and installation of the housing members due to a spring mechanism located in the rear bulkhead which urges the housing members into engagement with the front bulkhead. Movement of the housing members toward the rear bulkhead causes the spring mechanism to deflect thus allowing the front of the housing members to clear the front bulkhead and be removed. Installation of the protective housing is achieved by reversing the steps for removal.

DETAILED DESCRIPTION OF THE DRAWING

FIG. 3 also shows, in phantom, the installation of the upper housing member into the front and rear bulkhead assemblies.

FIG. 6 is an end view of the inside of the rear bulkhead assembly.

FIG. 7 is an exploded view of the rear bulkhead assembly shown in FIG. 6.

FIG. 8 is a side elevation view of the inside of the upper housing member.

FIG. 9 is a side elevation view of the inside of the lower housing member.

FIG. 10 is an exploded view of a rear bulkhead assembly showing the use of a wavy washer for the spring means.

DESCRIPTION OF THE PREFERRED EMBODIMENT

Figure 1:
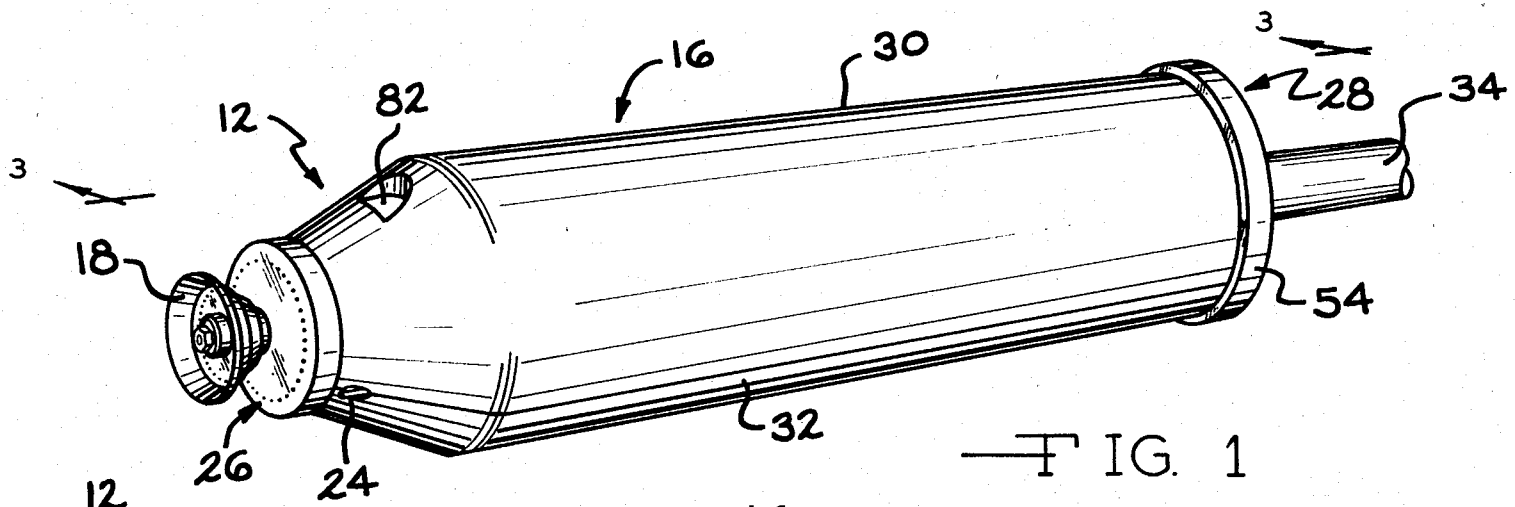
FIG. 1 is a side elevational view of the coating apparatus housing according to the invention.
Figure 2:
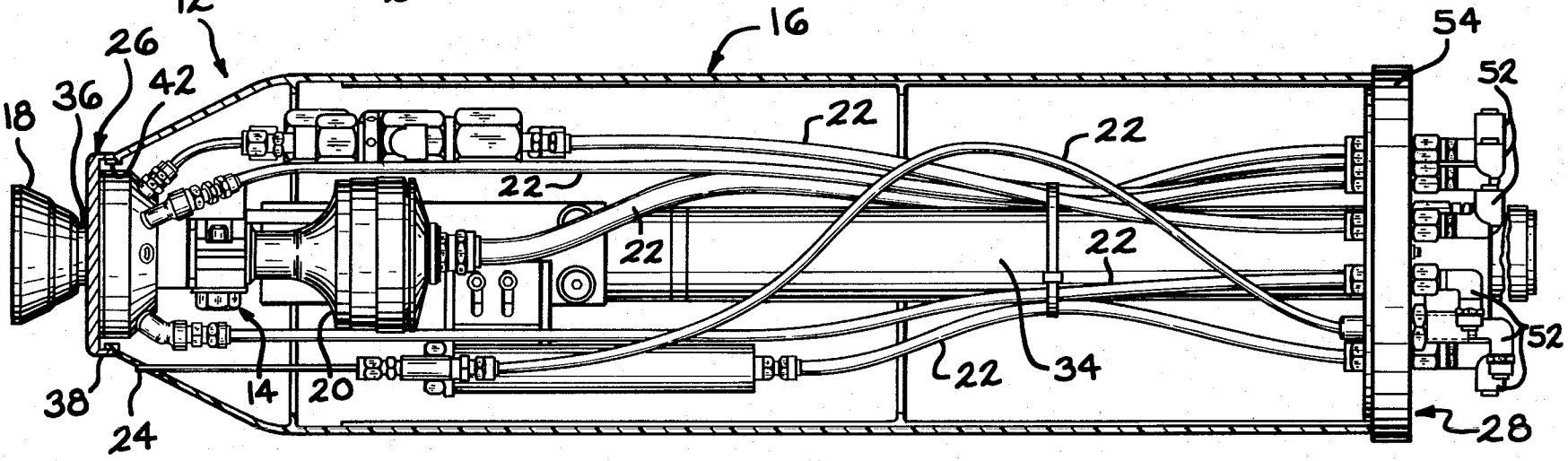
FIG. 2 is a cutaway side view of the housing and internal components of the coating apparatus taken along line 3—3 of FIG. 1.

The invention relates to a coating applicator 12 as generally depicted in FIGS. 1 and 2. The present embodiment of the applicator 12 is shown being used in conjunction with a rotary bell atomizer 14. It should be understood, however, that other types of coating applicators can be used in conjunction with the present invention, including but not limited to, nozzles, rotary discs, etc., without departing from the scope of the invention.

The housing 16 is primarily designed to cover and protect the portion of the coating applicator 12 located behind the dispensing head or bell 18 while still allowing quick and easy access to the components of the applicator 12.

The housing 16 in FIGS. 1 and 2 is shown covering the rearward portion of a rotary bell atomizer 14. The atomizer 14 consists of a bell or dispensing unit 18, a rotary air turbine 20 and assorted supply lines 22 which provide air, coating material and solvent to the atomizer 14. The atomizer 14 also has a bell wash tube 24 which protrudes from the housing 16 to allow cleaning of the bell 18. A more detailed description of the atomizer 14 is not warranted as the present invention is designed to be used with coating dispensers in general, with the rotary atomizer being used for illustration purposes only.

The present invention consists of a housing 16 which comprises three main sections; the front bulkhead 26, the rear bulkhead 28 and a pair of housing members 30 and 32. The entire coating applicator 12, including the housing 16, is supported by a support member 34 to which the rotary bell atomizer 14 is mounted.

The front bulkhead 26 is located directly behind the bell 18 and acts as a retaining means or collar for the housing members 30 and 32. The shaft 36 of the turbine 20 passes through the front bulkhead 26 and is connected to the rotary bell 18 which is free to rotate while the front bulkhead 26 remains stationary.

Figures 3, 4, 5:
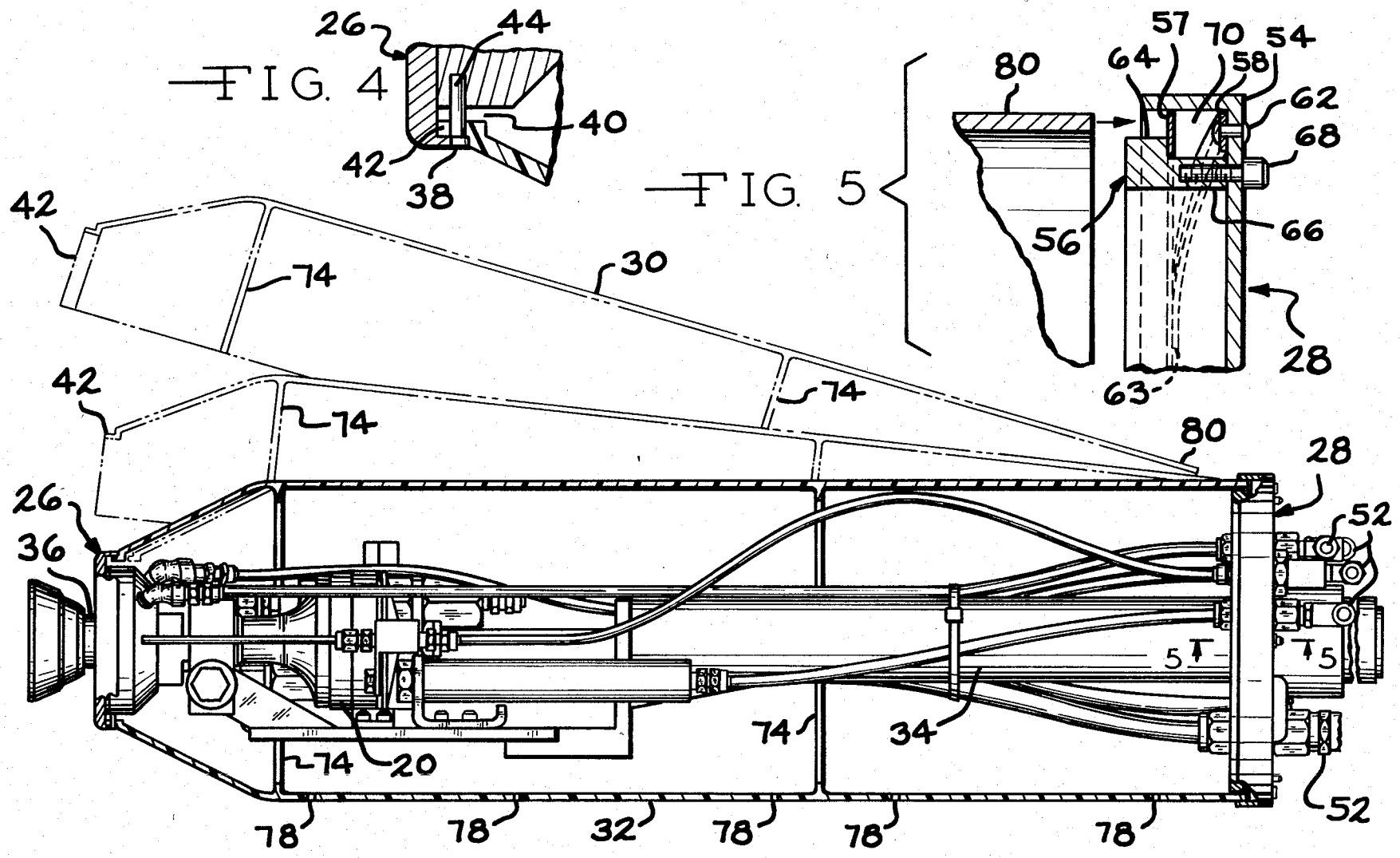
FIG. 3 is a cutaway view of the opposite side of the housing and internal components shown in FIG. 2.
FIG. 4 is an enlarged view of the alignment fitting located in the front bulkhead assembly of FIG. 3.
FIG. 5 is a partial view of the rear of a housing member and the rear bulkhead assembly taken along line 5—5 of FIG. 3.

As shown in FIGS. 2 and 4, the front bulkhead 26 is cup-shaped and has a rearwardly extending lip 38 thereby defining a recess 40 into which the front flange 42 of housing members 30 and 32 are designed to fit.

Referring to FIGS. 4 and 9, the front bulkhead 26 has an alignment pin 44 which extends inwardly from the lip 38. A corresponding notch 46 is provided in housing member 32 thereby ensuring proper alignment of the housing members 30 and 32 during installation and removal.

Current rotary bell atomizers will often have a shaping air cap and manifold located directly behind the atomizer bell. Consequently, it is also possible to provide a modified air cap/manifold assembly which can be used as the front bulkhead 26 for the present invention.

The rear bulkhead 28 is in opposed relationship to the front bulkhead 26 and serves to accept and retain the housing members 30 and 32 from the rear. Referring to FIGS. 6 and 7, the rear bulkhead 28 has a large hole 48 and several smaller holes 50. The larger hole 48 allows the rear bulkhead 28 to be positioned about and secured to the support member 34 by any suitable means including set screws, brackets or welding (not shown). The remaining smaller holes 50 allow connections to be made between the supply lines 22 and the external supply lines (not shown). As is shown in FIGS. 2 and 3, connections of these lines can be facilitated through the use of suitable coupler fittings 52.

Referring to FIGS. 7 and 10, the rear bulkhead assembly 28 consists of three main parts: a cup-shaped member 54, a retaining ring 56 and a spring means 58 disposed between the base member 54 and the retaining ring 56.

Two types of spring means 58 are shown in FIGS. 7 and 10. However, these particular spring means 58 are only illustrative of the possible types of spring means which can be used in the present invention and should in no way limit the types of spring means which can be used while still remaining within the scope of the present invention.

In FIG. 7, the spring means consist of a plurality of butterfly springs 60 which are secured to the base member 54 by means of rivets 62. The outermost edges 63 of the butterfly springs 60 extend upwardly and away from the base member 54. The distance that the outermost edges 63 of the butterfly springs 60 extend above the base member 54 is controlled by the retaining ring 56. A flat washer 57 may be interposed between the outermost edges 63 of the butterfly springs 60 and the outer ridge or lip 64 of retaining ring 56. The washer 57 serves to more evenly distribute the spring forces to the housing members 30 and 32.

The retaining ring 56 has an outer ridge or lip 64 and a sleeve 66 which depends downwardly from the lip 64. The sleeve 66 fits inside the butterfly springs 60 and is secured to the base member 54 with screws 68.

Referring to FIGS. 5 and 6, the lip 64 retains the butterfly springs 60 while still leaving an annular spring loaded cavity 70 exposed to receive the housing members 30 and 32 which deflect the butterfly springs 60 downwardly when a force is applied on the housing members 30 and 32 in a direction toward the rear bulkhead 28. The rear bulkhead 28 in FIG. 10 operates in the same manner as the bulkhead 28 depicted in FIG. 7, the only difference being in the type of spring means 58 used. FIG. 10 shows a wavy washer 72 which is used in place of the butterfly springs 60 shown in FIG. 7. The wavy washer 72 can also be deflected downwardly when the housing members 30 and 32 are urged in a direction toward the rear bulkhead 28.

The housing members 30 and 32 are shown in FIGS. 8 and 9 respectively. The main and rear portions of the members 30 and 32 are of uniform diameter while the front portion is conical shaped with a flange portion 42 which is designed to fit within the front bulkhead 26. Each of the housing members 30 and 32 have supporting ribs 74 positioned circumferentially about their interiors.

The lower housing member 32 is fitted with alignment plates 76 which allow proper mating of the two housing member halves. In addition, the housing member 32 has several holes 78 which allow drainage in the event that a fluid is released within the housing 16.

The housing members 30 and 32 can be made of any suitable material. If the coating applicator 12 uses high voltages that pose potential shock hazards, it is recommended that a non-conductive material such as polyethylene or non-conductive fiberglass be used in construction.

Assembly of the present invention is quick and easy due to its novel design and does not require any tools. Referring to FIGS. 3, 5 and 6 the lower housing member 32 is attached first by sliding its rear semi-circle portion 80 into the annular spring loaded cavity 70 in the rear bulkhead 28. By pushing the housing member 32 into the spring loaded cavity 70, the front flange 42 of the housing member 32 can be slipped under the lip 38 of the front bulkhead 26. Once past this lip 38, proper alignment of the housing member 32 is achieved by aligning the notch 46 in the housing member 32 with the pin 44 in the front bulkhead 26. Having properly aligned the pin 44 in notch 46, the spring force of the spring means 58 urges the housing member 32 toward the front bulkhead 26, thus maintaining the housing member 32 in an engaged relationship with the front and rear bulkheads 26 and 28 respectively.

The upper housing member 30 is then installed by placing it over the lower housing member 32 so that it straddles the alignment plates 76 which are along the edges of the lower housing member 32. The upper housing member 30 is then slid rearwardly so that its rear edge 80 fits into the spring loaded cavity 70 of the rear bulkhead 28. Referring to FIG. 1, a thumb recess 82 is located in the front portion of the upper housing member 30 to aid installation. A sufficient force is applied to the housing member 30 to depress the spring means 58 and allow the front flange 42 of the housing member 30 to be slide under the lip 38 of the front bulkhead 26. The housing member 30 is then allowed to move toward the front bulkhead 26 by virtue of the spring means 58 in the rear bulkhead 28.

To remove the housing, the operator simply uses the thumb recess 82 to urge the upper housing member 30 further into the rear bulkhead 28. Once the front flange 42 clears the lip 38 of the front bulkhead 26, the front of the housing member 30 is lifted up and away from the front bulkhead 26. The rear 80 of the housing member 26 is then removed from the rear bulkhead 28 thus exposing the internal components of the coating applicator 12. The same procedure is used to remove the lower housing member 32, except that the operator grips the alignment plates 76 to depress the housing member 32 since there is no thumb recess 82 located in the lower housing member 32.

Having thus described the present invention it should be understood that various modifications can be made without departing from the scope and content of the following claims.

What we claim is:

1. A housing for a coating applicator including a coating dispenser and means for supplying coating material to the coating dispenser, said housing comprising in combination, a front bulkhead adjacent the coating dispenser, a pair of mating housing members defining a chamber for a portion of the coating applicator, said housing members defining longitudinally extending mating edges, means on each of said housing members for engagement with said front bulkhead, a rear bulkhead spaced from said front bulkhead, said front bulkhead and said rear bulkhead supporting said mating housing members in surrounding relationship to said portion of said coating applicator, said rear bulkhead including a cup-shaped base for receiving said housing members, and spring means for urging at least one of said housing members against one of said bulkheads.

2. A housing for a coating applicator including a coating dispenser and means for supplying coating material to the coating dispenser, said housing comprising in combination, a front bulkhead adjacent the coating dispenser, a pair of mating housing members defining a chamber for a portion of the coating dispenser, flange means adjacent the front ends of said housing members for reception with said front bulkhead, a rear bulkhead assembly positioned adjacent the rear ends of said housing members and receiving said housing members, said rear bulkhead assembly including a cup-shaped base, a retaining ring positioned within said cup-shaped base and spring means disposed between said base and said ring, said spring means having a portion in engaging relationship with said rear end of said housing members for urging said housing members toward said front bulkhead, whereby at least one of said housing members may be removed by compressing said spring means and removing such housing members from said front bulkhead.

3. A housing for a coating applicator according to claim 2, wherein at least one of said housing members includes an alignment plate extending outwardly from one of said housing members, said alignment plate being received by the other one of said housing members when said housing members are in the mating position.

4. A housing for a coating applicator according to claim 3, including an alignment fitting, said alignment fitting comprising a pin located in said front bulkhead and a corresponding notch in one of said housing members, whereby said housing member and said front bulkhead may be held in an aligned relationship.

5. A housing for a coating applicator according to claim 2, wherein at least one of said housing members includes a finger recess for facilitating the removal of said housing member from said coating apparatus.

6. A housing for a coating applicator according to claim 2, wherein at least one of said housing members includes a plurality of drain holes.

7. A housing for a coating applicator according to claim 2, wherein said spring means comprises a deflectable wavy washer.

8. A housing for a coating applicator according to claim 2, wherein said spring means comprises a plurality of butterfly springs.

9. A housing for a coating applicator according to claim 2, wherein said retaining ring has an outer diameter less than the outer diameter of said spring means, whereby an exposed contact surface exists on said spring means, said surface being in an engaging relationship with said rear ends of said housing members.

10. A housing for a coating applicator according to claim 2, wherein said housing comprises polyethylene.

11. A housing for a coating applicator according to claim 2, wherein said housing comprises non-conductive fiberglass.

12. A housing for a coating applicator including a coating dispenser and means for supplying coating material to the coating dispenser, said housing comprising in combination, a front bulkhead adjacent the coating dispenser, a pair of mating housing members defining a chamber for a portion of the coating dispenser, flange means adjacent the front ends of said housing members for reception with said front bulkhead, a rear bulkhead assembly positioned adjacent the rear ends of said housing members and receiving said housing members, said rear bulkhead assembly including a cup-shaped base, a retaining ring positioned within said cup-shaped base, spring means positioned between said base and said ring and a spring washer positioned between said ring and said spring, said washer having a portion in engaging relationship with said rear end of said housing members for urging said housing members toward said front bulkhead, whereby at least one of said housing members may be removed by compressing said spring means and removing such housing members from said front bulkhead.

* * * * *